US006249257B1

(12) United States Patent
Powles et al.

(10) Patent No.: US 6,249,257 B1
(45) **Date of Patent: *Jun. 19, 2001**

(54) SWITCHED, DUAL HELICAL, RETRACTABLE, DUAL BAND ANTENNA FOR CELLULAR COMMUNICATIONS

(75) Inventors: Jon J. Powles, Weeping Water; Todd M. Blacksher, Lincoln, both of NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/615,915

(22) Filed: Jul. 13, 2000

Related U.S. Application Data

(63) Continuation of application No. 09/364,318, filed on Jul. 30, 1999.

(51) Int. Cl.[7] ..... H01Q 1/24
(52) U.S. Cl. ..... 343/702; 343/895; 343/900
(58) Field of Search ..... 343/702, 715, 343/895, 900, 901; H01Q 1/24, 1/36

(56) References Cited

U.S. PATENT DOCUMENTS 3,803,627 4/1974 Schuscheng .
4,205,319 5/1980 Gasparaitis et al. .

(List continued on next page.)

FOREIGN PATENT DOCUMENTS

0747990A1 12/1996 (EP) .
6-85519 3/1994 (JP) .
6-252621 9/1994 (JP) .

OTHER PUBLICATIONS

"Lightweight Trap Antennas—Some Thoughts", by Doug DeMaw Jun. 1983.

*Primary Examiner*—Tho Phan
(74) *Attorney, Agent, or Firm*—Zarley, McKee, Thomte, Voorhees & Sease; Dennis L. Thomte

(57) ABSTRACT

A switched, dual helical, retractable, dual band antenna for a cellular communication device comprising a device which functions at two specific frequency bands when in the retracted mode and which functions at two specific frequency bands when in the extended mode. The antenna includes an elongated radiator which is in circuit when the antenna is in its extended position and includes inner and outer helical radiators which are in circuit when the antenna is in the retracted mode.

4 Claims, 2 Drawing Sheets

U.S. PATENT DOCUMENTS

| | | | | |
|---|---|---|---|---|
| 4,760,401 | | 7/1988 | Imazeki . | |
| 4,772,895 | | 9/1988 | Garay et al. . | |
| 4,849,767 | | 7/1989 | Naitou . | |
| 4,867,698 | | 9/1989 | Griffiths . | |
| 4,868,576 | * | 9/1989 | Johnson | 343/702 |
| 5,079,558 | | 1/1992 | Koike . | |
| 5,177,492 | | 1/1993 | Tomura et al. . | |
| 5,204,687 | * | 4/1993 | Elliott et al. | 343/702 |
| 5,218,370 | | 6/1993 | Blaese . | |
| 5,245,350 | | 9/1993 | Sroka . | |
| 5,300,940 | | 4/1994 | Simmons . | |
| 5,317,325 | | 5/1994 | Bottomley . | |
| 5,341,149 | | 8/1994 | Valimaa et al. . | |
| 5,353,036 | | 10/1994 | Baldry . | |
| 5,374,937 | | 12/1994 | Tsunekawa et al. . | |
| 5,446,469 | | 8/1995 | Makino . | |
| 5,455,595 | | 10/1995 | Yokoyama et al. . | |
| 5,467,096 | | 11/1995 | Takamoro et al. . | |
| 5,469,177 | * | 11/1995 | Rush et al. | 343/702 |
| 5,479,178 | | 12/1995 | Ha . | |
| 5,594,457 | | 1/1997 | Wingo . | |
| 5,612,704 | | 3/1997 | Cole . | |
| 5,646,635 | | 7/1997 | Cockson et al. . | |
| 5,650,789 | | 7/1997 | Elliott et al. . | |
| 5,659,889 | | 8/1997 | Cockson . | |
| 5,710,567 | | 1/1998 | Funke . | |
| 5,734,351 | | 3/1998 | Ojantakanen et al. . | |
| 5,764,191 | | 6/1998 | Tsuda . | |
| 5,801,662 | | 9/1998 | Itoh . | |
| 5,812,097 | | 9/1998 | Maldonado . | |
| 5,825,330 | | 10/1998 | Na et al. . | |
| 5,831,579 | | 11/1998 | Rudisill . | |
| 5,835,065 | | 11/1998 | Wallace et al. . | |
| 5,859,617 | | 1/1999 | Fujikawa . | |
| 5,861,859 | | 1/1999 | Kanayama et al. . | |
| 5,945,953 | * | 8/1999 | Tsuda et al. | 343/702 |

* cited by examiner

SWITCHED, DUAL HELICAL, RETRACTABLE, DUAL BAND ANTENNA FOR CELLULAR COMMUNICATIONS

CROSS-REFERENCE TO RELATED APPLICATION

This is a continuation application of Petitioners' earlier application Ser. No. 09/364,318 filed Jul. 30, 1999, entitled A SWITCHED, DUAL HELICAL, RETRACTABLE, DUAL BAND ANTENNA FOR CELLULAR COMMUNICATIONS

BACKGROUND OF THE INVENTION

1. Field of the Invention

This invention relates to a multi-band antenna and more particularly to a switched, dual band, retractable antenna for a cellular communication device with the antenna automatically operating at two different frequency bands when the antenna is in its retracted position and when it is in its extended position.

2. Description of the Related Art

Due to overcrowding of the cellular telephone infrastructure, the cellular telephone industry is looking for ways to create room for the ever-increasing number of cellular telephone subscribers. The creation of room for additional cellular telephone subscribers must be accomplished without degrading the quality of the audio signal or compromising the reliability or integrity of the wireless connection. Much research has been done in this area and several possible solutions have been suggested. One solution is to switch from the existing analog to digital systems, which has been proven to create better performance in terms of quality of signal and speed. In other words, digital technology provides the carrier with the ability to fit more cellular conversations in a given band width as compared to the analog system.

Another solution for the problem described above is to create more room in terms of frequency bandwidth. The FCC has allocated more frequency bands to be used for cellular telephone conversations. This new band of spectrum is located around the 2 Ghz band and is used for telephone systems such as PCS band (Personal Communication System), DCS 1800, and DECT. This higher band was chosen primarily because of the availability of bands close to the original 800–900 MHz.

Unfortunately, the changes outlined above have created additional problems in the industry. The cellular telephone infrastructure in the United States and in other countries was originally built for the 800 to 900 MHz frequencies. Now, with the advent of digital systems and the use of the new higher frequencies, a dilemma arises in switching over to the new system Many geographical areas will add the higher frequencies and the digital systems as a second system and will keep the original analog system operational. Some locations will stay with the old analog systems longer than others; therefore, to ensure full coverage, the user will either have to carry two telephones or purchase a "Multi-Mode" telephone. A "Multi-Mode" telephone is a telephone that will automatically switch from one system to the other depending upon the way it is programmed.

SUMMARY OF THE INVENTION

The switched, dual band, retractable antenna of this invention provides an antenna system for a cellular communication device which will effectively resonate at two separate frequency bands when the antenna is in its extended position and will resonate at two separate frequency bands when the antenna is in its retracted position. The cellular communication device includes a housing having a receptacle at the upper end thereof which is RF coupled to the circuitry of the device with the circuitry including a matching network. An electrically conductive conductor is positioned in the bore of the receptacle and is electrically coupled to the receptacle. An elongated first radiator is provided and has an electrically conductive bottom stop mounted on the lower end thereof which is electrically coupled thereto. An insulating sheath covers the first radiator above the bottom stop and extends beyond or above the upper end of the first radiator. A first electrically conductive contact is positioned on the sheath above the upper end of the first radiator. A second electrically conductive contact is positioned within the connector and is electrically coupled thereto. A non-conductive outer housing has its lower end embracing the upper end of the connector. A third electrically conductive contact is positioned within the outer housing above the second contact and is electrically insulated from the second contact and the connector. Inner and outer helical radiators are positioned in the outer housing and have their lower ends in electrical contact with the third contact. The first radiator is movable between retracted and extended positions with respect to the device and the outer housing. The bottom stop is in electrical contact with the first contact when the first radiator is in its extended position so that the first radiator will be able to transmit and receive in two separate frequency bands in the extended position. When the first radiator is in its extended position, the inner and outer helical radiators are electrically disconnected from the circuitry of the cellular communication device. When the first radiator is in its retracted position, the first radiator is electrically disconnected with the inner and outer helical radiators being connected to the circuitry of the device so that the inner and outer helical radiators will resonate at two separate frequencies.

It is a principal object of the invention to provide an antenna that will resonate at two specific frequencies.

It is a further object of the invention to provide a switched, dual band, retractable antenna for a cellular communication device which is capable of resonating at two separate frequencies when in the extended position and two separate frequencies when in the retracted position.

A further object of the invention is to provide a switched, dual band, retractable antenna which is easily detached from a communication device or secured thereto.

Yet another object of the invention is to provide an antenna of the type described which shows no degradation of electrical performance (gain) when compared to a single band antenna system of equal electrical length.

Still another object of the invention is to provide an antenna of the type described in which the monofilar radiation element and the two helical wound radiating elements operate independently of one another.

Still another object of the invention is to provide an antenna of the type described which is within the packaging parameters of most wireless communication devices.

Yet another object of the invention is to provide an antenna of the type described which has a robust electrical and mechanical design that can easily be tailored to any operational frequency band within the wireless communication frequency spectrum.

These and other objects will be apparent to those skilled in the art.

DESCRIPTION OF THE PREFERRED EMBODIMENT

Figure 1:
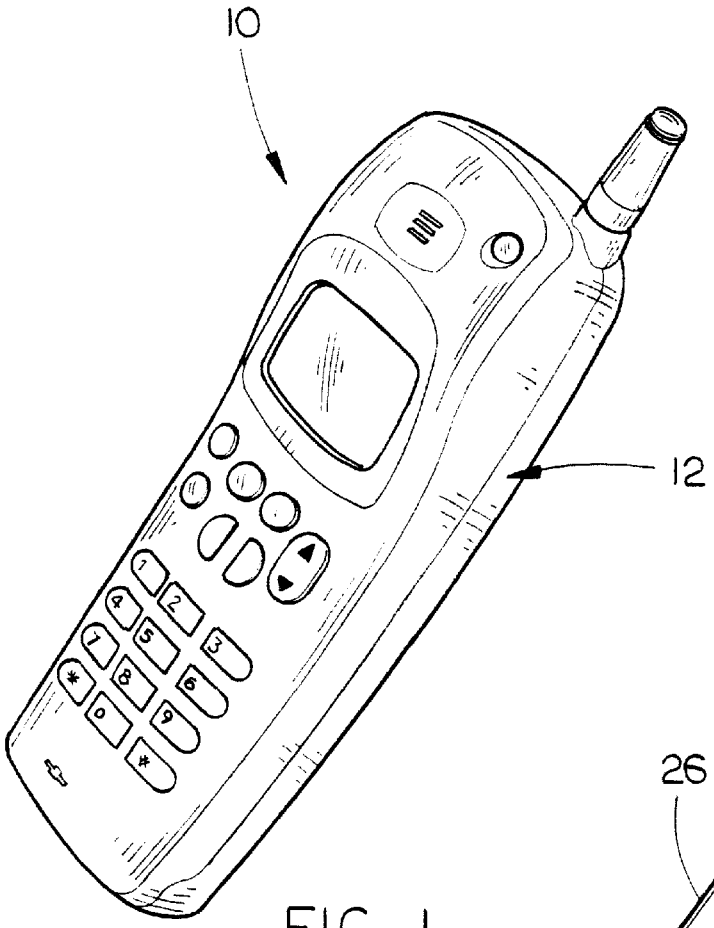
FIG. 1 is a perspective view of a cellular telephone having the dual band antenna of this invention mounted thereon.
Figure 2:
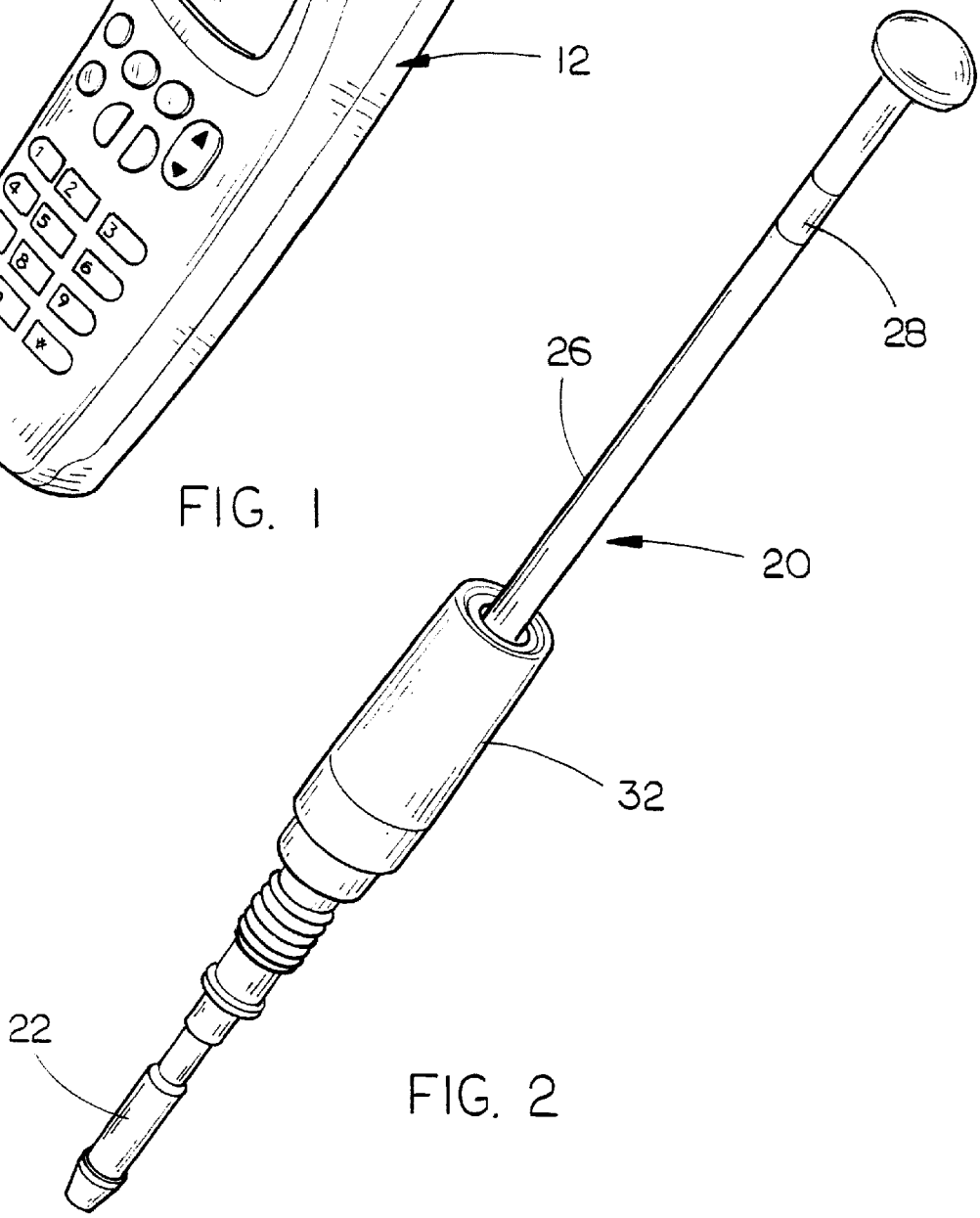
FIG. 2 is a perspective view of the antenna of this invention.

Referring to the drawings, the numeral 10 refers to a conventional cellular telephone including a housing 12. The telephone 10 includes conventional circuitry therein and would include a simple impedance matching device such as a single element inductor or capacitor. Although the antenna of this invention is ideally suited for use with cellular telephones, it is conceivable that it could be used with other types of wireless communication devices. Thus, when the term "cellular communication device" is used throughout this application, it should be understood that the same could also apply to other types of wireless communication devices.

Telephone 10 includes a housing 12 having a receptacle 14 provided at the upper end therewith which in the drawings is shown to be internally threaded, but it should be understood that the receptacle could accommodate snap-in types of connectors. The numeral 16 refers to an electrically conductive connector which is threaded into the receptacle 14 and which is electrically connected to the circuitry of the telephone in conventional fashion. Preferably, connector 16 is comprised of brass with a conductive plating thereon. Connector 16 includes a bore 18 extending upwardly therethrough to permit the antenna to be retracted and extended, as will be described hereinafter.

The antenna of this invention is referred to generally by the reference numeral 20. Antenna 20 includes an electrically conductive bottom stop 22, preferably of brass construction with a conductive plating thereon. A monofilar radiator or radiating element is referred to generally by the reference numeral 24 and is preferably constructed of nickel titanium. Radiator 24 is electrically coupled to the bottom stop 22 and extends upwardly therefrom. A non-conductive sheath 26 embraces or enclosed radiator 24 and extends upwardly beyond the upper end of the radiator 24, as see in FIGS. 3 and 4. Sliding contact 28 embraces sheath 26 above the upper end of radiator 24 and is electrically conductive and preferably constructed of a stainless steel material with a conductive plating thereon. Contact 28 is what is frequently referred to as a sliding contact.

Figure 3:
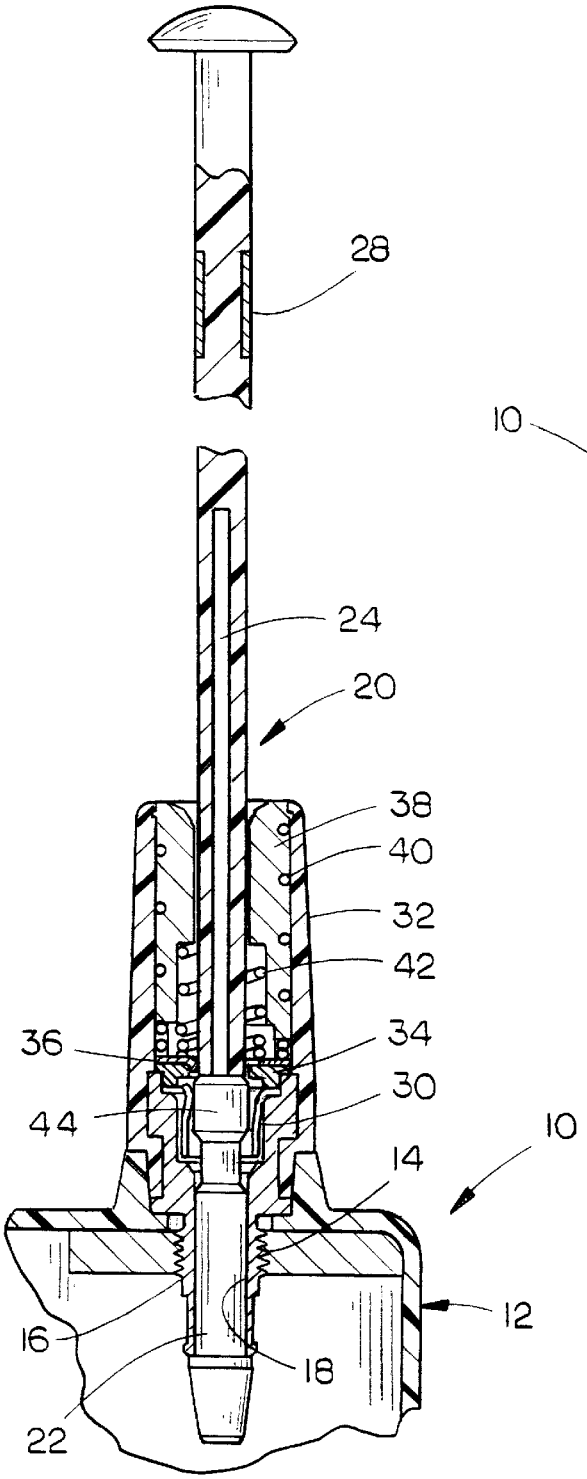
FIG. 3 is a longitudinal section of the antenna of this invention in its extended position.
Figure 4:
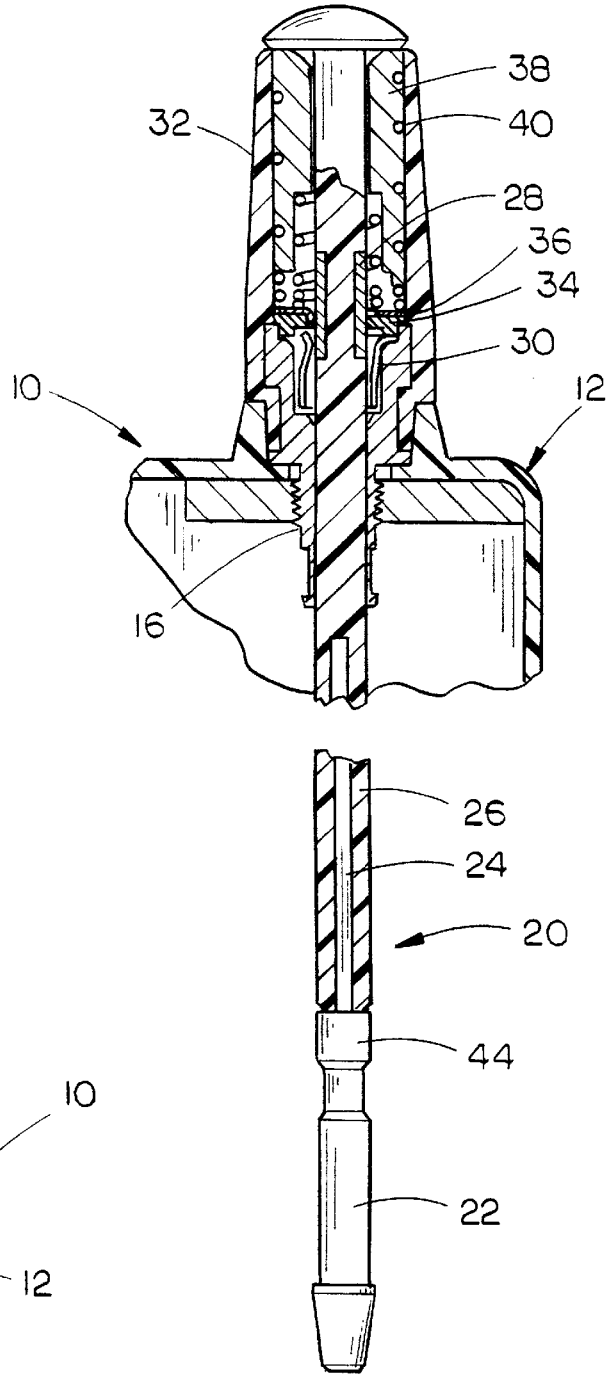
FIG. 4 is a view similar to FIG. 3 except that the antenna is shown in its retracted position.

An electrically conductive spring contact 30 is positioned within connector 16 and is electrically coupled thereto. An insulated outer housing 32, preferably comprised of a plastic material, has its lower end embracing the upper end of connector 16, as seen in FIGS. 3 and 4. Insulator 34 is positioned within outer housing 32 at the upper end of connector 16, as seen in FIGS. 3 and 4. Spring contact 36 is positioned at the upper end of insulator 34. The numeral 38 refers to a coilform positioned within outer housing 32 and which has outer helical radiator 40 supported thereon. Coilform 38 maintains the pitch of the outer helical radiator 40 and separates radiator 40 from the inner helical radiator 42. The lower ends of the helical radiators 40 and 42 are in electrical contact with the spring contact 36. The helical radiators 40 and 42 are preferably comprised of beryllium copper.

When the antenna is in the extended position of FIG. 3, the bottom stop portion 44 is in electrical contact with the spring contact 30 so that the radiator 24 is coupled to the circuitry of the telephone through the bottom stop portion 44, spring contact 30 and connector 16. When the antenna is in the extended position of FIG. 3, the helical radiators 40 and 42 are electrically disconnected. The monofilar radiator 24 has a wavelength of approximately ¼ wavelength at one frequency band and the shunt element of the matching circuit is used to match the other frequency band. Thus, in the extended position, the antenna will transmit and receive two specific bands.

When the antenna is in the retracted position illustrated in FIG. 4, the radiator 24 is electrically disconnected. In the retracted position of FIG. 4, the sliding contact 28 is in electrical contact with the contacts 36 and 30 so that the helical radiators 40 and 42 are electrically connected to the circuitry of the telephone through the connector 16. In the retracted mode, one of the helical radiators 40 and 42 has a length of approximately ¼ wavelength with the shunt matching element in the matching circuit being used to match the other helical radiator for the desired frequency band. Thus, in the retracted mode, the helical radiators transmit and receive in two specific frequency bands. The matching element may be an inductor or capacitor which is electrically connected to the connector 16 in the retracted and extended positions.

Thus it can be seen that a switched, dual helical, retractable, dual band antenna has been provided for a cellular communication device, with the antenna automatically resonating at two specific frequencies whether the antenna is in the retracted mode or in the extended mode.

It can also be seen that the antenna of this invention is easily detachable from the communication device and that the antenna falls within the packaging parameters of most wireless communication devices. The antenna of this invention has a robust electrical and mechanical design that can easily be tailored to any operational frequency band within the wireless communication frequency spectrum. The antenna of this invention shows no degradation of electrical performance (gain) when compared to a single band antenna system of equal electrical length. In the antenna of this invention, the monofilar radiator 24 operates independently of the radiator elements 40 and 42 and vice versa.

Thus it can be seen that the invention accomplishes at least all of its stated objectives.

We claim:

1. A retractable, dual band antenna for a cellular communication device which transmits at two separate frequencies and receives at two separate frequencies in either the retracted mode or the extended mode.

2. The antenna of claim 1 wherein the antenna is selectively removably mounted on the device.

3. A retractable, dual band antenna including an elongated radiator which transmits at two separate frequencies and receives at two separate frequencies when the antenna is in its extended position and further including inner and outer helical radiators which transmit at two separate frequencies and receive at two separate frequencies when the antenna is in the retracted mode.

4. The antenna of claim 3 wherein said elongated radiator operates independently of said helical radiators.

* * * * *